US005472323A

United States Patent [19]

Hirabayashi et al.

[11] Patent Number: 5,472,323

[45] Date of Patent: Dec. 5, 1995

[54] MOVABLE MAGNET TYPE PUMP

[75] Inventors: Yasuyuki Hirabayashi; Takatoshi Oyama; Sigeo Saito, all of Tokyo, Japan

[73] Assignee: TDK Corporation, Tokyo, Japan

[21] Appl. No.: 177,329

[22] Filed: Jan. 4, 1994

[30] Foreign Application Priority Data

Jan. 7, 1993 [JP] Japan ..... 5-016938
Jun. 3, 1993 [JP] Japan ..... 5-156323

[51] Int. Cl.[6] ..... F04B 17/03; F04B 53/12

[52] U.S. Cl. ..... 417/417; 417/549; 417/552; 417/554; 310/35; 92/162 P

[58] Field of Search ..... 417/410 R, 415, 417/416, 417, 505, 549, 552, 553, 554; 310/32, 34, 35; 92/162 P

[56] References Cited

U.S. PATENT DOCUMENTS

| | | | |
|---|---|---|---|
| 3,384,021 | 5/1968 | Perron . | |
| 3,485,441 | 12/1969 | Eaton | 417/505 |
| 4,376,618 | 3/1983 | Toyoda et al. | 417/417 |
| 4,541,787 | 9/1985 | DeLong | 417/554 |
| 4,610,658 | 9/1986 | Buchwald et al. | 417/417 |
| 4,775,301 | 10/1988 | Cartwright et al. | 417/417 |
| 4,808,089 | 2/1989 | Buchholtz et al. | 417/505 |

FOREIGN PATENT DOCUMENTS

| | | | |
|---|---|---|---|
| 0457389 | 11/1991 | European Pat. Off. . | |
| 1703413 | 1/1972 | Germany . | |
| 2143230 | 3/1972 | Germany | 417/505 |
| 2812481 | 9/1979 | Germany | 417/417 |
| 3033684 | 4/1982 | Germany . | |
| 3132897 | 3/1983 | Germany . | |
| 51-3006 | 1/1976 | Japan . | |
| 51-24726 | 7/1976 | Japan . | |
| 55-142981 | 11/1980 | Japan . | |
| 3-19400 | 3/1991 | Japan . | |
| 1372097 | 2/1988 | U.S.S.R. | 417/417 |
| 1350797 | 4/1974 | United Kingdom . | |
| 2017420 | 10/1979 | United Kingdom | 417/417 |

*Primary Examiner*—Richard A. Bertsch
*Assistant Examiner*—Roland G. McAndrews, Jr.
*Attorney, Agent, or Firm*—Oblon, Spivak, McClelland, Maier, & Neustadt

[57] ABSTRACT

A movable magnet type pump, wherein a magnet moving body having at least one axially magnetized permanent magnet and an axially extending through liquid passage is arranged so as to be slidable inside a liquid introducing chamber; a plurality of coils are fixed so as to enclose the liquid introducing chamber; a first check valve is arranged on a liquid introducing side of the liquid introducing chamber; a second check valve is arranged on a liquid discharge side of the through liquid passage; and the magnet moving body is caused to reciprocate by interaction between current applied to the respective coils and magnetic flux from the magnet moving body cutting across the respective coils.

11 Claims, 11 Drawing Sheets

MOVABLE MAGNET TYPE PUMP

BACKGROUND OF THE INVENTION

The invention relates to a small movable magnet type pump for use in pumping liquid such as water or kerosene.

A conventional small pump is an electromagnetic pump (a solenoid pump) that has an exciting coil for driving a magnetic piston in one direction and a return spring for returning the magnetic piston to the original position (For example, Japanese Patent Unexamined Publication (Kokai) Sho-55-142981).

The conventional electromagnetic pump combining the magnetic piston and the exciting coil must involve a mechanical return mechanism such as a spring, and this imposes the problem of not only complicating the mechanism but also making the structure large. In addition, to increase the operating force of the piston, the magnetic piston and the exciting coil must be large in structure. It is for this reason that small or very small pumps with sufficient liquid rasing power have been difficult to achieve in the conventional ordinary type electromagnetic pumps.

SUMMARY OF THE INVENTION

The invention has been made in view of the above circumstances. Accordingly, the object of the invention is to provide a small movable magnet type pump not only having large pumping power, but also achieving mechanical simplification by arranging a magnet moving body with a through liquid passage or a magnet moving body with a groove serving as a liquid passage on the outer circumference thereof, and causing such magnet moving body to reciprocate within a liquid introducing chamber so that a mechanical return mechanism is no longer necessary.

To achieve the above object, the invention is applied to a movable magnet type pump, wherein a magnet moving body having at least one axially magnetized permanent magnet and an axially extending liquid passage or a groove serving as an outer circumferential liquid passage is disposed within a liquid introducing chamber so as to be slidable; a plurality of coils are fixed so as to enclose the liquid introducing chamber; at least one first check valve (a fixed check valve) is disposed on a liquid passage communicating with the liquid introducing chamber; at least one second check valve (a movable check valve) is disposed on the liquid passage of the magnet moving body; and the magnet moving body is caused to reciprocate by interaction between current applied to the respective coils and magnetic flux from the magnet moving body cutting across the respective coils.

The groove may be formed on the outer circumference so as to be inclined with respect to the axial direction of the magnet moving body.

The magnet moving body may be formed by interposing a magnetic body between at least two permanent magnets, the same poles of the two permanent magnets confronting each other; the plurality of coils may be at least three coils; and the at least three coils may be connected in such a manner that current flows in directions different from one another with a zone between the respective permanent magnets as a boundary; or else, the magnet moving body may be formed by interposing an intermediate magnetic body between at least two permanent magnets, the same poles of the two permanent magnets confronting each other, and by disposing end magnetic bodies on outer end surfaces of the outermost permanent magnets; the plurality of coils may be at least three coils; and the at least three coils may be connected in such a manner that current flows in directions different from one another with a zone between the respective permanent magnets as a boundary.

Further, a magnetic yoke may be disposed on an outer circumferential side of the coils to thereby form a magnetic circuit for increasing a magnetic flux component in a direction perpendicular to the axial direction of the magnet moving body.

The first check valve may include a first magnetic valve body and a valve body attracting permanent magnet for biasing the first magnetic valve body in such a direction as to close the liquid passage communicating with the liquid introducing chamber with the valve body attracting permanent magnet.

The second check valve may have a second magnetic valve body, and bias the second valve body in such a direction as to close the liquid passage with the permanent magnet or magnets of the magnet moving body.

In the movable magnet type pump of the invention, the magnet moving body having the through liquid passage or the magnet moving body having the groove serving as the outer circumferential liquid passage is disposed within the liquid introducing chamber so as to be slidable, and such magnet moving body is driven by an operating force similar to a thrust produced between the magnet moving body and the coils based on the Fleming's left hand rule. Therefore, the magnet moving body can be caused to reciprocate electromagnetically directly by ac voltage, which contributes to mechanical simplification, eliminating the need for a mechanical return mechanism such as the spring. In addition, producing no deviation in a direction perpendicular to the reciprocating direction of the movable magnet body, the magnet moving body can be operated smoothly. Further, the operating force of the magnet moving body is increased significantly compared with the force produced by the magnetic piston and the exciting coil of the conventional electromagnetic pump, thereby allowing a small or very small but sufficiently powerful pump to be implemented. Still further, the arrangement in which the magnet moving body has the grooves is more advantageous in downsizing and fabricating the pump compared with the arrangement in which the magnet moving body has the through hole. In addition, the former arrangement is advantageous in providing good waterproof of the permanent magnet or magnets contained in the magnet moving body.

In the movable magnet type pump of the invention, a movable magnet type actuator including a magnet moving body and a plurality of coils such as is disclosed in U.S. patent Ser. No. 093,677 (European Patent Application No. 93111583.6) can be used.

DETAILED DESCRIPTION OF THE PREFERRED EMBODIMENTS

Movable magnet type pumps, which are embodiments of the invention, will now be described with reference to the appended drawings.

Figure 1:
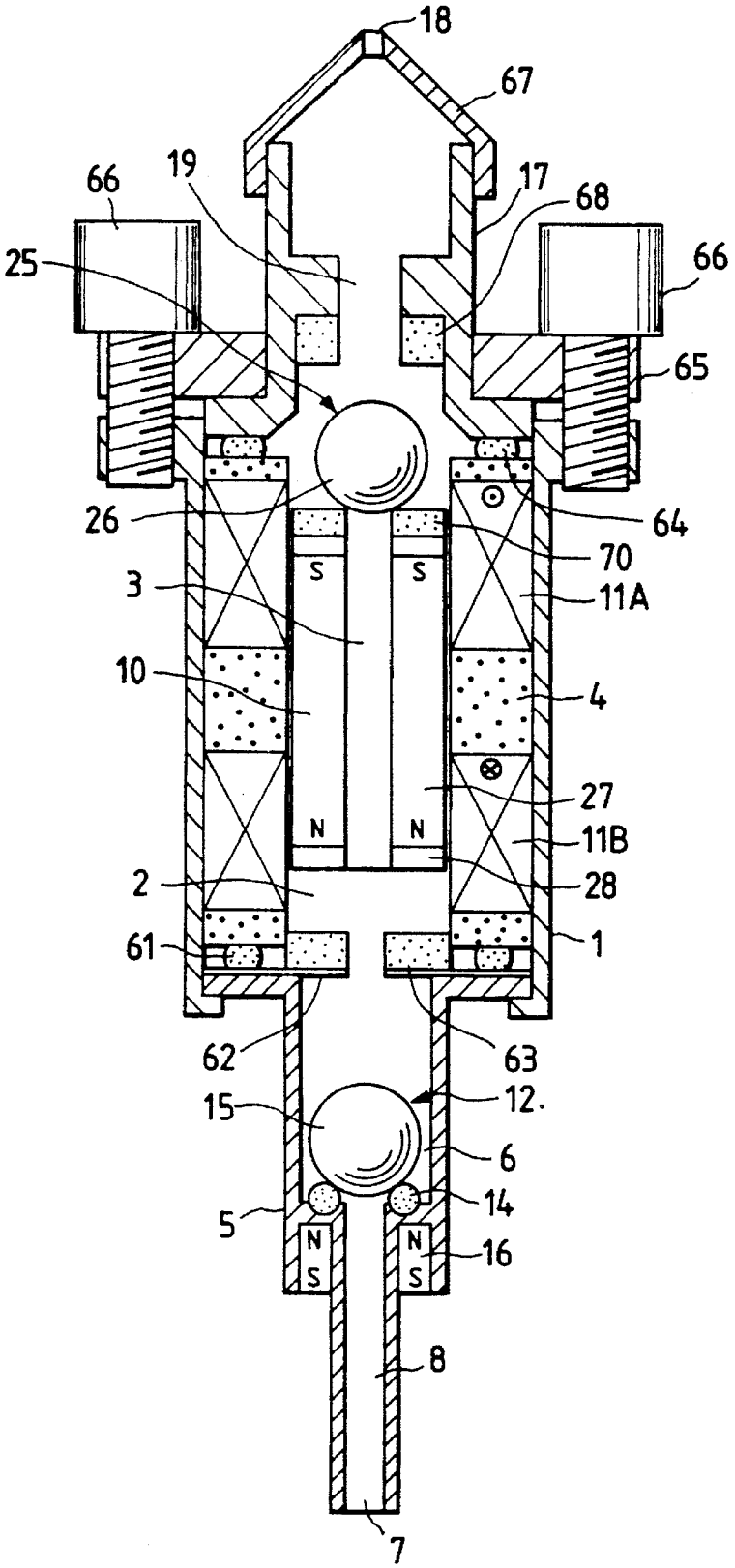
FIG. 1 is a front sectional view showing a movable magnet type pump, which is a first embodiment of the invention.

FIG. 1 shows a first embodiment of the invention. As shown in FIG. 1, a movable magnet type pump according to the first embodiment has a soft magnetic cylindrical yoke 1, two sets of coils 11A, 11B disposed inside the cylindrical yoke 1, and a magnet moving body 10. The two sets of coils 11A, 11B are fixed on the cylindrical yoke 1 by a guide sleeve 4. The inner circumference of the guide sleeve 4 forms a liquid introducing chamber 2 for slidably guiding the magnet moving body 10. The guide sleeve 4 is made of an insulating material (nonmagnetic material) such as an insulating resin or the like.

The magnet moving body 10 is formed by covering a rod-like rare earth permanent magnet 27 with a nonmagnetic sleeve-like holder 28. The permanent magnet 27 is magnetized in the axial direction so as to have magnetic poles on both end surfaces thereof. A through liquid passage 3 is formed in the middle of the magnet moving body 10 so that the passage 3 can run through along the length of the body 10. While the sleeve-like holder 28 covers the permanent magnet 27 in such a manner as to form the outer circumference and both end surfaces of the magnet moving body 10, it is most preferable that the sleeve-like holder 28 cover as far as to the inner circumference of the through liquid passage 3 (i.e., the entire surface of the magnet moving body 10 be covered by the nonmagnetic holder 28). For example, a preferable arrangement may be such that a one-piece, double-wall pipe structure made from, e.g., stainless steel is used as the sleeve-like holder 28; and after the permanent magnet 27 having a through hole already formed therewithin has been accommodated in the pipe structure, both end surfaces of the pipe structure are closed.

The coils 11A, 11B are annularly wound around the end parts of the magnet moving body 10, and are connected so that the neighboring parts of the coils have the same magnetic poles. Magnetic flux from the respective end surfaces of the magnet moving body 10 cuts across the coils 11A, 11B.

A liquid introducing side member 5 is fixed on an end of the guide sleeve 4 constituting the liquid introducing chamber 2 watertight through an O-ring 61 and a stopper plate 62. The liquid introducing side member 5 has an opening on one end thereof as a liquid introducing opening 7, and has a liquid introducing path 8 that communicates with the liquid introducing chamber 2 on the other end thereof. A first check valve 12 is disposed on a large-diameter part 6 that is formed in the middle of the liquid introducing path 8. That is, the first check valve 12 includes: a seal member 14 made from rubber or the like firmly disposed on a portion of the large-diameter part 6 which is supposed to serve as a valve seat; a magnetic valve body 15 made of a steel ball or the like which closes the liquid introducing path 8 when the valve body 15 comes in pressure contact with the seal member 14; and a valve body attracting permanent magnet 16 that is disposed on the outer end of the liquid introducing side member 5. Therefore, the magnetic valve body 15 is biased in such a direction as to come in pressure contact with the seal member 14 by the valve body attracting permanent magnet 16. It is preferable that the liquid introducing side member 5 be nonmagnetic.

A cushion member 63 for regulating the stroke of the magnet moving body 10 is secured to a surface of the stopper plate 62, the surface confronting the magnet moving body 10.

A liquid discharge side member 17 is fixed on the other end of the liquid introducing chamber 2 constituting guide sleeve 4 so as to be watertight through an O-ring 64. That is, a holding plate 65 for holding a flange part of the liquid discharge side member 17 from above is put on a flange part of the cylindrical yoke 1 and secured thereto by bolts 66. The liquid discharge side member 17 has a liquid discharge path 19 that communicates with the liquid introducing chamber 2. A nozzle member 67 having a liquid discharge opening 18 is secured to a distal end of the liquid discharge side member 17, the liquid discharge opening 18 communicating with the liquid discharge path 19.

Further, a magnetic valve body 26 made of a steel ball or the like is disposed so that a second check valve 25 is formed together with an end surface on the liquid discharge side of the magnet moving body 10. The magnetic valve body 26 is attracted in such a direction as to close the through liquid passage 3 by the permanent magnet 27 inside the magnet moving body 10. A seal member 70 made from rubber or the like is fixed on the end surface on the liquid discharge side of the magnet moving body 10. Further, a cushion member 68 for regulating the strokes of the valve body 26 and the magnet moving body 10 is fixed on a recess inside the liquid discharge side member 17.

In the construction of the first embodiment, the magnet moving body 10 can be caused to reciprocate inside the liquid introducing chamber 2 by applying alternating current while connecting the two coils 11A, 11B in such a manner that the neighboring parts thereof have the same magnetic poles. As a result, in a stroke toward the liquid discharge side, the magnet moving body 10 moves with the magnetic valve body 26 of the second check valve 25 closing the through liquid passage 3, which thus allows liquid (e.g., liquid such as water or kerosene) to be introduced into the liquid introducing chamber 2 via the liquid introducing opening 7, the liquid introducing path 8, and the first check valve 12. In a stroke toward the liquid introducing side, the magnet moving body 10 moves with the magnetic valve body 15 of the first check valve 12 closing the liquid introducing path 8, which thus allows the liquid inside the liquid introducing chamber 2 to move toward the liquid discharge side of the magnet moving body 10 via the second check valve 25. As the magnet moving body 10 further moves toward the liquid discharge side, the liquid is discharged from the liquid discharge opening 18 via the liquid discharge path 19.

An operation of this pump will be described with reference to FIG. 3.

Figures 3A, 3B, 3C, 3D:
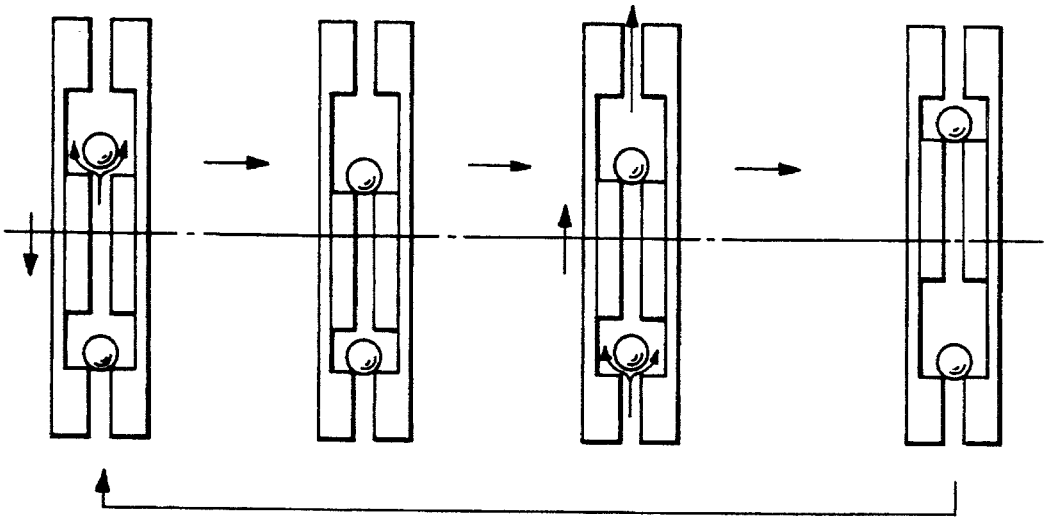
FIG. 3 is a diagram showing an operation of the first or the second embodiment of the invention.

In a stroke in which the magnet moving body 10 moves toward the liquid introducing side (part (a) of FIG. 3), the magnet moving body 10 moves toward the liquid introducing side with the first check valve 12 closing the liquid introducing path 8 and with the second check valve 25 open. Therefore, the liquid inside the liquid introducing chamber 2 moves toward the liquid discharge side of the magnet moving body 10 via the second check valve 25.

When the magnet moving body 10 has moved closest to the liquid introducing side (part (b) of FIG. 3), the second check valve 25 gets closed.

In a stroke in which the magnet moving body 10 moves toward the liquid discharge side (part (c) of FIG. 3), the magnet moving body 10 moves with the first check valve 12 open and with the second check valve 25 closing the through liquid passage 3. Therefore, the liquid that has moved toward the liquid discharge side in the stroke (part (a) of FIG. 3) is discharged from the liquid discharge opening 18 via the liquid discharge path 19. At the same time, the liquid inside the liquid introducing chamber 2 is introduced via the liquid introducing opening 7, the liquid introducing path 8, and the first check valve 12.

The first check valve 12 gets closed when the magnet moving body 10 has moved closest to the liquid discharge side (part (d) of FIG. 3).

By repeating the strokes (parts (a) to (d) of FIG. 3), the liquid raising operation is performed.

According to the first embodiment of the invention, the magnet moving body 10 can be caused to reciprocate efficiently by a force similar to a thrust based on Fleming's left hand rule that acts on both the magnetic flux produced from the permanent magnet of the magnet moving body 10 and the current flowing through the two coils 11A, 11B that cut across the magnetic flux. As a result, a mechanism such as a return spring or the like is no longer necessary, thus allowing mechanical simplification to be achieved. Further, the reciprocating motion of the magnet moving body 10 can be smooth owing to good frequency response of the current applied to the coils 11A, 11B. High-speed operation is hence possible by increasing the frequency. Still further, the arrangement in which the through liquid passage 3 is formed in the magnet moving body 10 leads to effective cooling of the magnet moving body 10. Still further, the first and the second check valves 12, 25 are of such a simple design that the magnetic valve bodies 15, 26 made of steel balls or the like are attracted by the permanent magnets, which is another advantage in achieving mechanical simplification. Still further, the structure in which the magnet moving body 10 is formed by covering the permanent magnet 27 with the nonmagnetic holder 28 can prevent the permanent magnet 27 from rusting, and improve wear resistance of the magnet moving body 10.

Figure 2:
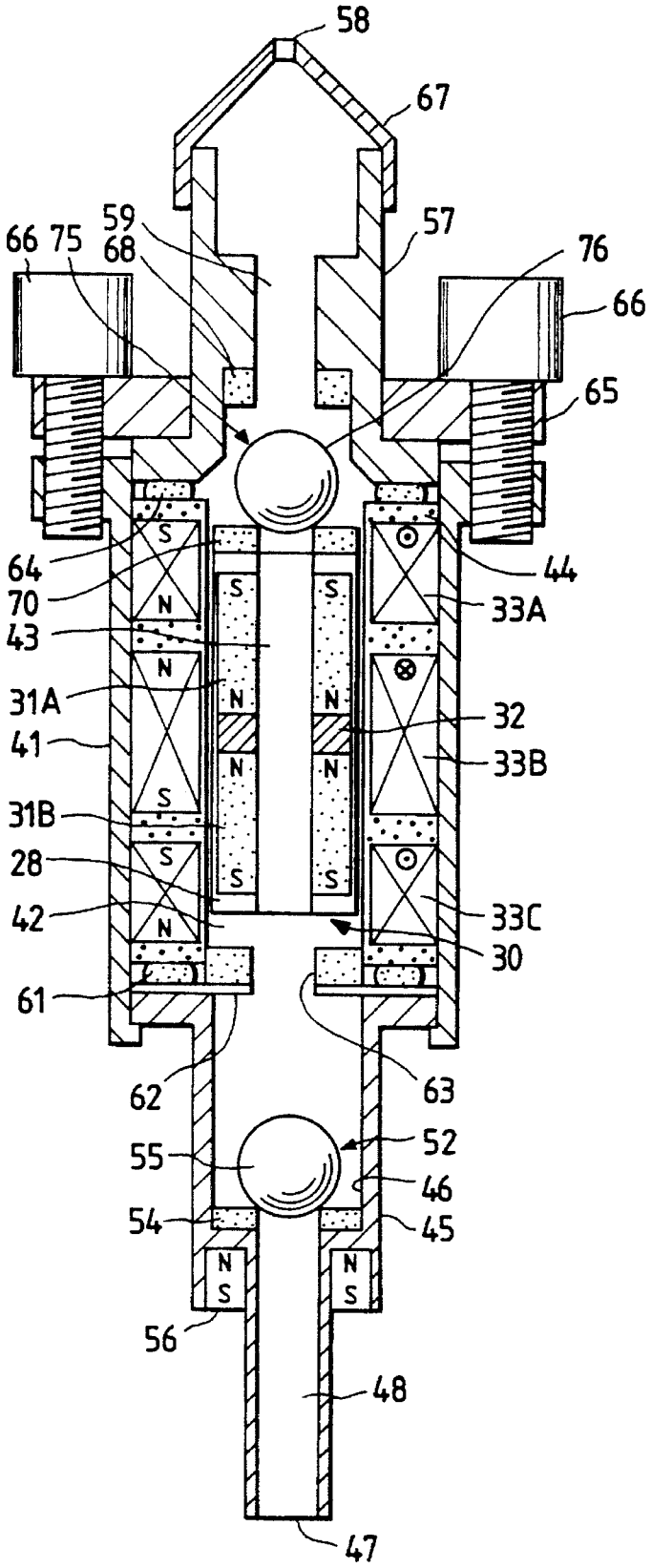
FIG. 2 is a front sectional view showing a movable magnet type pump, which is a second embodiment of the invention.

FIG. 2 shows a second embodiment of the invention. As shown in FIG. 2, a movable magnet type pump according to the second embodiment has a soft magnetic cylindrical yoke 41, three sets of coils 33A, 33B, 33C disposed inside the cylindrical yoke 41, and a magnet moving body 30. The three sets of coils 33A, 33B, 33C are fixed on the cylindrical yoke 41 by a guide sleeve 44. The inner circumference of the guide sleeve 44 forms a liquid introducing chamber 42 for slidably guiding the magnet moving body 30. The guide sleeve 44 is made of an insulating material (nonmagnetic material) such as an insulating resin or the like.

The magnet moving body 30 includes: two rod-like rare earth permanent magnets 31A, 31B disposed with the same poles thereof confronting each other; a cylindrical soft magnetic body 32 interposed between these permanent magnets 31A, 31B; and a nonmagnetic sleeve-like holder 28. A through liquid passage 43 is formed in the middle of the magnet moving body 30 so that the passage 43 can run through along the length of the body 30. These permanent magnets 31A, 31B and the soft magnetic body 32 are firmly integrated with one another while accommodated in the sleeve-like holder 28. While the sleeve-like holder 28 covers the permanent magnets and the soft magnetic body so as to form the outer circumference and both end surfaces of the magnet moving body 30, it is most preferable that the sleeve-like holder 28 cover as far as to the inner circumference of the through liquid passage 43 (i.e., the entire surface of the magnet moving body 30 be covered by the nonmagnetic holder 28). For example, a preferable arrangement may be such that a one-piece, double-wall pipe structure made from, e.g., stainless steel is used as the sleeve-like holder 28; and after the permanent magnets 31A, 31B having a through hole already formed therewithin and the soft magnetic body 32 have been accommodated in the pipe structure, both end surfaces of the pipe structure are closed.

The coils 33A, 33B, 33C are annularly wound around the end parts of the magnet moving body 30, and are connected so that current flows in directions different from one another with a zone between the poles of the permanent magnets 31A, 31B as a boundary. That is, it is so designed that the coil 33B in the middle encloses the end parts including the soft magnetic body 32 and the N-poles of the permanent magnets 31A, 31B, and that the coils 33A, 33C on both ends enclose the end parts including the S-poles of the permanent magnets 31A, 31B. The direction of the current flowing through the coil 33B in the middle is opposite to that of the current flowing through the coils 33A, 33C on both ends (see N, S put on the respective coils shown in FIG. 2).

A liquid introducing side member 45 is fixed on an end of the liquid introducing chamber 42 constituting guide sleeve 44 so as to be watertight through an O-ring 61 and a stopper plate 62. The liquid introducing side member 45 has an opening on one end thereof as a liquid introducing opening 47, and has a liquid introducing path 48 that communicates with the liquid introducing chamber 42 on the other end thereof. A first check valve 52 is disposed on a large-diameter part 46 that is formed in the middle of the liquid introducing path 48. That is, the first check valve 52 includes: a seal member 54 made from rubber or the like firmly disposed on a portion of the large-diameter part 46 which is supposed to serve as a valve seat; a magnetic valve body 55 made of a steel ball or the like which closes the liquid introducing path 48 when the valve body 55 comes in pressure contact with the seal member 54; and a valve body attracting permanent magnet 56 that is disposed on the outer end of the liquid introducing side member 45. Therefore, the magnetic valve body 55 is biased in such a direction as to come in pressure contact with the seal member 54 by the valve body attracting permanent magnet 56. It is preferable that the liquid introducing side member 45 be nonmagnetic.

A cushion member 63 for regulating the stroke of the magnet moving body 30 is secured to a surface of the stopper plate 62, the surface confronting the magnet moving body 30.

A liquid discharge side member 57 is fixed on the other end of the liquid introducing chamber 42 constituting guide sleeve 44 so as to be watertight through an O-ring 64. That is, a holding plate 65 for holding a flange part of the liquid discharge side member 57 from above is put on a flange part of the cylindrical yoke 41 and secured thereto by bolts 66. The liquid discharge side member 57 has a liquid discharge path 59 that communicates with the liquid introducing chamber 42. A nozzle member 67 having a liquid discharge opening 58 is secured to a distal end of the liquid discharge side member 57, the liquid discharge opening 58 communicating with the liquid discharge path 59.

Further, a magnetic valve body 76 made of a steel ball or the like is disposed so that a second check valve 75 is formed together with an end surface on the liquid discharge side of the magnet moving body 30. The magnetic valve body 76 is attracted in such a direction as to close the through liquid passage 43 by the permanent magnet 31A inside the magnet moving body 30. A seal member 70 made from rubber or the like is fixed on the end surface on the liquid discharge side of the magnet moving body 30. Further, a cushion member 68 for regulating the strokes of the valve body 76 and the magnet moving body 30 is fixed on a recess inside the liquid discharge side member 57.

In the construction of the second embodiment, the magnet moving body 30 can be caused to reciprocate inside the liquid introducing chamber 42 by applying alternating current to the three coils 33A, 33B, 33C in such a manner that each of the three coils 33A, 33B, 33C can generate a magnetic field of an opposite polarity alternately. As a result, in a stroke toward the liquid discharge side, the magnet moving body 30 moves with the magnetic valve body 76 of the second check valve 75 closing the through liquid passage 43, which thus allows liquid (e.g., liquid such as water or kerosene) to be introduced into the liquid introducing chamber 42 via the liquid introducing opening 47, the liquid introducing path 48, and the first check valve 52. In a stroke toward the liquid introducing side, the magnet moving body 30 moves with the magnetic valve body 55 of the first check valve 52 closing the liquid introducing path 48, which thus allows the liquid inside the liquid introducing chamber 42 to move toward the liquid discharge side of the magnet moving body 30 via the second check valve 75. As the magnet moving body 30 further moves toward the liquid discharge side, the liquid is discharged from the liquid discharge opening 58 via the liquid discharge path 59.

According to the second embodiment of the invention, the magnet moving body 30 can be caused to reciprocate efficiently by a force similar to a thrust due to Fleming's left hand rule that acts on both the magnetic flux produced from the respective permanent magnets of the magnet moving body 30 and the current flowing through the three coils 33A, 33B, 33C that cut across the magnetic flux. Since the magnet moving body 30 is formed of a structure in which the soft magnetic body is interposed between the two permanent magnets with the same poles of the permanent magnets confronting each other, a magnetic flux density component perpendicular to the direction of magnetization (axial direction) of the respective permanent magnets can be increased sufficiently and the magnetic flux generated by all the poles of the permanent magnets can be utilized efficiently. Therefore, the thrust due to Fleming's left hand rule that acts on the magnetic flux and the current flowing through the three coils 33A, 33B, 33C wound around the magnet moving body 30 can be increased sufficiently. Thus, even if the magnet moving body 30 is downsized, a drive force therefor can be increased significantly. Other effects and advantages are similar to those obtained by the first embodiment.

Figure 4:
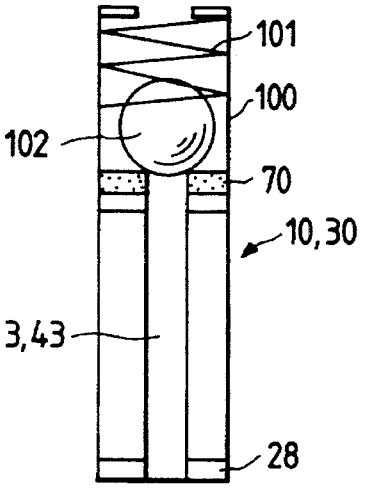
FIG. 4 is a partially sectional view showing a modified example of a second check valve in the first or the second embodiment.

FIG. 4 shows a modified example of the second check valve in the first or the second embodiment. An extension 100 of the nonmagnetic sleeve-like holder 28 is disposed on the liquid discharge side of the magnet moving body 10, 30 so that the extension 100 can hold a spring 101 and a valve body 102 that is in spherical or like form. Therefore, the valve body 102 is biased by the spring 101 in such a direction as to come in pressure contact with the seal member 70 disposed on the end surface on the liquid discharge side of the magnet moving body 10, 30 to thereby close the through liquid passage 3, 43. It is not necessary that the valve body 102 be magnetic in the construction of FIG. 4.

Figure 5:
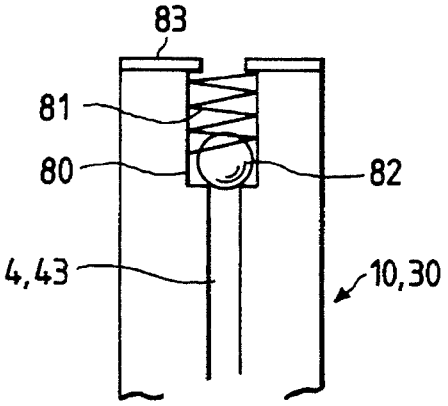
FIG. 5 is a partially sectional view showing another modified example of the second check valve in the first or the second embodiment.
Figure 7:
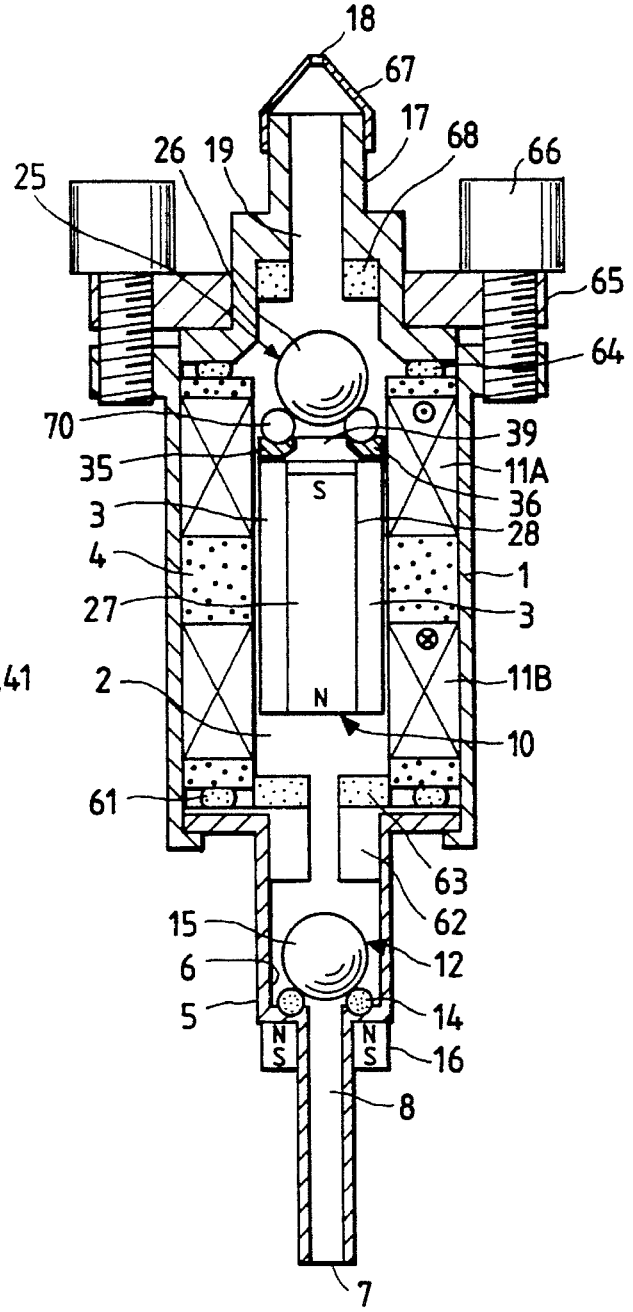
FIG. 7 is a front sectional view showing a movable magnet type pump, which is a third embodiment of the invention.

FIG. 5 shows another modified example of the second check valve in the first or the second embodiment. A recess 80 is formed on the liquid discharge side of the magnet moving body 10, 30; an opening of the through liquid passage 3, 43 is formed on the recess 80; and the opening is closed by a valve body 82 biased by a spring 81, the valve body 82 being in spherical or like form. A spring retainer 83 is secured to the end surface on the liquid discharge side of the magnet moving body 10, 30. In the construction of FIG. 5, it is not necessary that the valve body 82 be magnetic.

Figure 6:
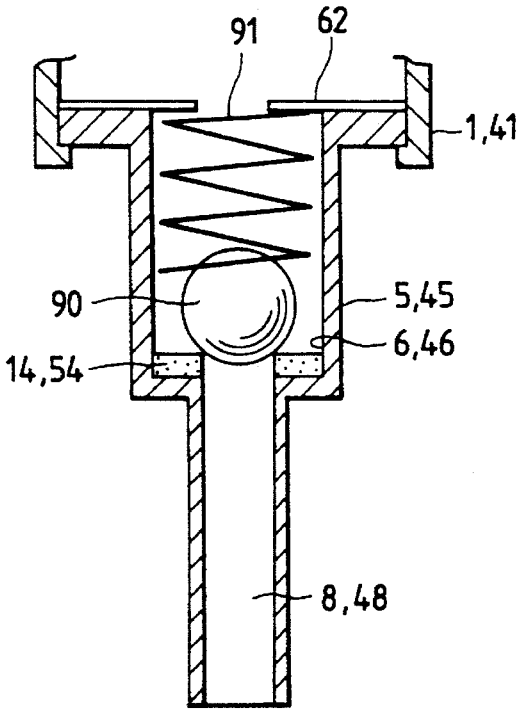
FIG. 6 is a partially sectional view showing a modified example of a first check valve in the first or the second embodiment.

FIG. 6 shows a modified example of the first check valve in the first or the second embodiment. The seal member 14, 54 made from rubber or the like is fixed on a portion of the large-diameter part 6, 46 of the liquid introducing member 5, 45, the portion being provided to serve as a valve seat; and a valve body 90 that is in spherical or like form is biased by a spring 91 so that the valve body 90 comes in pressure contact with the seal member 14, 54. The stopper plate 62 functions as a spring retainer. Reference numerals 1, 14 designate a yoke; and 8, 48, a liquid introducing path. Like the other modified examples, it is not necessary that the valve body 90 be magnetic in the construction of FIG. 6.

Structures other than those shown in FIGS. 4 to 6 may also be applied to the first and the second check valves.

FIGS. 7 to 11 show a third embodiment of the invention. As shown in FIGS. 7 to 11, a movable magnet type pump according to the third embodiment has a soft magnetic cylindrical yoke 1, two sets of coils 11A, 11B disposed inside the cylindrical yoke 1, and a magnet moving body 10. The two sets of coils 11A, 11B are fixed on the cylindrical yoke 1 by a guide sleeve 4. The inner circumference of the guide sleeve 4 forms a liquid introducing chamber 2 for slidably guiding the magnet moving body 10. The guide sleeve 4 is made of an insulating material (nonmagnetic material) such as an insulating resin or the like.

Figure 8:
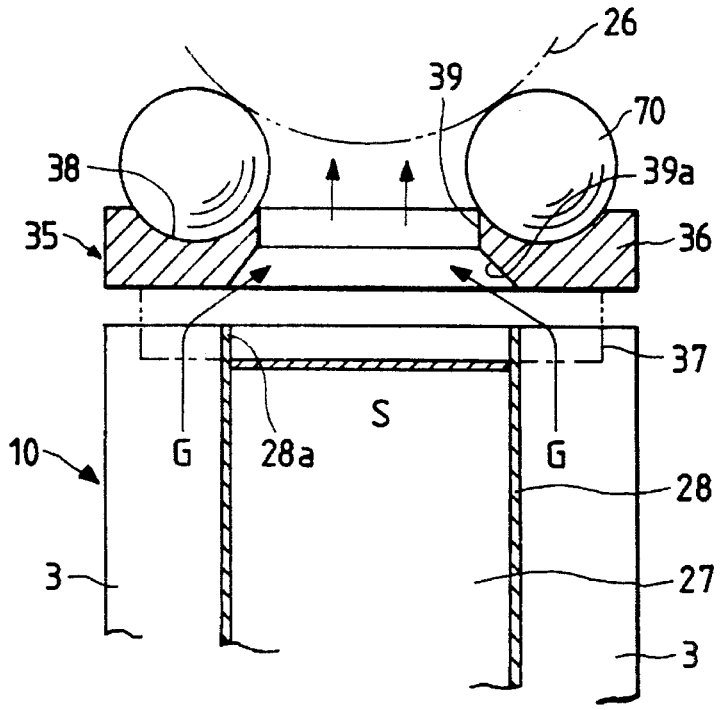
FIG. 8 is an enlarged front sectional view showing a magnet moving body and a valve seat part in the third embodiment.
Figure 9:
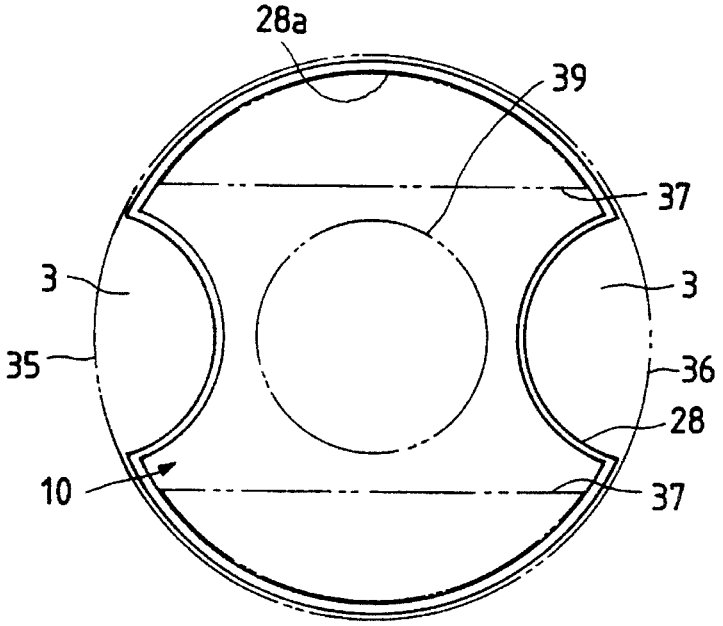
FIG. 9 is an enlarged plan view showing the magnet moving body in the third embodiment.
Figure 10:
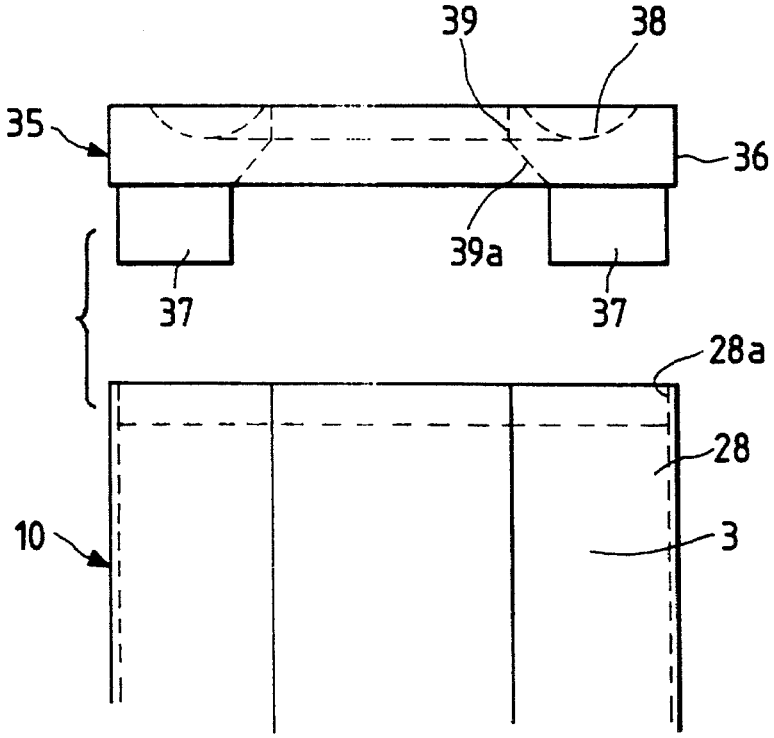
FIG. 10 is an enlarged exploded sectional view showing the magnet moving body and the valve seat part in the third embodiment.
Figure 11:
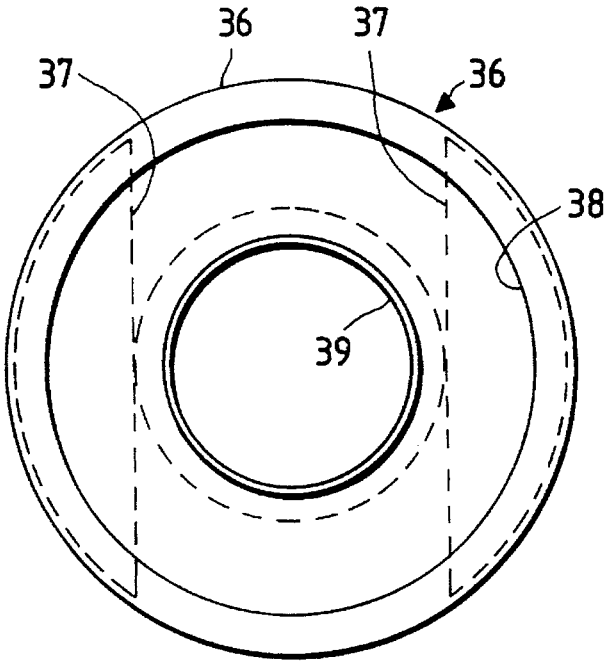
FIG. 11 is an enlarged plan view of the valve seat part in the third embodiment.

The magnet moving body 10 is formed by covering a substantially rod-like rare earth permanent magnet 27 with a nonmagnetic sleeve-like holder 28. The rare-earth permanent magnet 27 is magnetized in the axial direction so as to have magnetic poles on both end surfaces thereof. At least one of grooves 3 serving as liquid passage is formed in the axial direction on the outer circumference of the magnet moving body 10. That is, the sleeve-like holder 28 has the groove 3 on the outer circumference thereof, and the permanent magnet 27 is fixed inside the sleeve-like holder 28. It is preferable that the sleeve-like holder 28 cover not only the outer circumference of the permanent magnet 27, but also both end surfaces thereof. Also, a valve seat part 35 is integrally secured to the liquid discharge side of the magnet moving body 10. As shown in FIGS. 8 to 11, the valve seat part 35 includes: an annular part 36 whose diameter is the same as that of a portion of the sleeve-like holder 28 on which no grooves are formed; a pair of projections 37 that are formed on the back side of the annular part 36 and fitted into the inner circumferences of end parts of the sleeve-like holder 28; and a seal member accommodating groove 38 formed on the front side of the annular part 36. An inner circumferential hole 39 of the annular part 36 has a tapered surface 39*a* that is tapered from the back to the front side so that liquid (e.g., water or kerosene) having entered the grooves 3 can be collected toward the center. A seal member (O-ring) 70 made from rubber or the like is attached to the seal member accommodating groove 38. The projections 37 of the valve seat part 35 integrating the seal member 70 therewith are firmly fitted into inner circumferences 28*a* of the end parts of the sleeve-like holder 28 with an adhesive as shown in FIGS. 8 and 9.

The liquid having passed through the grooves 3 can reach the inner circumferential hole 39 of the annular part 36 by passing through a clearance between the annular part 36 of the valve seat part 35 and the sleeve-like holder 28. The clearance between the inner circumference of the liquid introducing chamber 2 and the outer circumference of the valve seat part 35 is very small, and the clearance between the inner circumference of the liquid introducing chamber 2 and the outer circumference of the part of the magnet moving body 10 in which no grooves 3 are formed is similarly very small. Thus, the presence of the clearances between the annular part 36 of the valve seat part 35 and the sleeve-like holder 28 will not cause inconvenience such as reverse flow of the liquid.

The permanent magnet 27 may have a section that coincides with the inner circumferential profile of the sleeve-like holder 28, or may be cylindrical or square pillar-like. If a clearance is formed between the sleeve-like holder 28 and the permanent magnet 27, a filler is loaded inside the sleeve-like holder 28 so that the permanent magnet 27 can be fixed on the sleeve-like holder 28.

The coils 11A, 11B are annularly wound around the end parts of the magnet moving body 10, and are connected so that the neighboring parts thereof have the same magnetic poles. Magnetic flux from the respective end surfaces of the magnet moving body 10 cuts across the coils 11A, 11B.

A liquid introducing side member 5 is fixed on an end of the liquid introducing chamber 2 constituting guide sleeve 4 so as to be watertight through an O-ring 61 and a stopper plate 62. The liquid introducing side member 5 has an opening on one end thereof as a liquid introducing opening 7, and has a liquid introducing path 8 that communicates with the liquid introducing chamber 2 on the other end thereof. A first check valve 12 is disposed on a large-diameter part 6 that is formed in the middle of the liquid introducing path 8. That is, the first check valve 12 includes: a seal member (O-ring) 14 made from rubber or the like firmly disposed on a portion of the large-diameter part 6 which is provided to serve as a valve seat; a magnetic valve body 15 made of a steel ball or the like which closes the liquid introducing path 8 when the valve body 15 comes in pressure contact with the seal member 14; and a valve body attracting permanent magnet 16 that is disposed on the outer end of the liquid introducing side member 5. Therefore, the magnetic valve body 15 is biased in such a direction as to come in pressure contact with the seal member 14 by the valve body attracting permanent magnet 16. It is preferable that the liquid introducing side member 5 be nonmagnetic.

A cushion member 63 for regulating the stroke of the magnet moving body 10 is secured to a surface of the stopper plate 62, the surface confronting the magnet moving body 10.

A liquid discharge side member 17 is fixed on the other end of the liquid introducing chamber 2 constituting guide sleeve 4 so as to be watertight through an O-ring 64. That is, a holding plate 65 for holding a flange part of the liquid discharge side member 17 from above is put on a flange part of the cylindrical yoke 1 and secured thereto by bolts 66. The liquid discharge side member 17 has a liquid discharge path 19 that communicates with the liquid introducing chamber 2. A nozzle member 67 having a liquid discharge opening 18 is secured to a distal end of the liquid discharge side member 17, the liquid discharge opening 18 communicating with the liquid discharge path 19.

Further, a magnetic valve body 26 made of a steel ball or the like is disposed so that a second check valve 25 is formed together with the seal member 70 on the liquid discharge side of the valve seat part 35 firmly integrated with the magnet moving body 10. The magnetic valve body 26 is attracted in such a direction as to close the inner circumferential hole 39 of the valve seat part 35 by the permanent magnet 27 inside the magnet moving body 10. A cushion member 68 for regulating the strokes of the valve body 26 and the magnet moving body 10 is fixed on a recess inside the liquid discharge side member 17.

In the construction of the third embodiment, the magnet moving body 10 can be caused to reciprocate inside the liquid introducing chamber 2 by applying alternating current while connecting the two coils 11A, 11B in such a manner that the neighboring parts thereof have the same magnetic poles. As a result, in a stroke toward the liquid discharge side, the magnet moving body 10 moves with the magnetic valve body 26 of the second check valve 25 closing the inner circumferential hole 39 of the valve seat part 35, which thus allows liquid (e.g., liquid such as water or kerosene) to be introduced into the liquid introducing chamber 2 via the liquid introducing opening 7, the liquid introducing path 8, and the first check valve 12. In a stroke toward the liquid introducing side, the magnet moving body 10 moves with the magnetic valve body 15 of the first check valve 12 closing the liquid introducing path 8, which thus allows the liquid inside the liquid introducing chamber 2 to move toward the liquid discharge side of the magnet moving body 10 via the second check valve 25. As the magnet moving body 10 further moves toward the liquid discharge side, the liquid is discharged from the liquid discharge opening 18 via the liquid discharge path 19.

According to the third embodiment of the invention, the magnet moving body 10 can be caused to reciprocate efficiently by a force similar to a thrust due to Fleming's left hand rule that acts on both the magnetic flux produced from the permanent magnet of the magnet moving body 10 and the current flowing through the two coils 11A, 11B that cut across the magnetic flux. As a result, a mechanism such as a return spring or the like is no longer necessary, thus allowing mechanical simplification to be achieved. Further, the reciprocating motion of the magnet moving body 10 can be smooth owing to good frequency response of the current applied to the coils 11A, 11B. High-speed operation is therefore possible by increasing the frequency. Still further, since the grooves 3 serving as the liquid passages are formed on the outer circumference of the magnet moving body 10, the magnet moving body 10 can be fabricated and downsized easily compared with the construction in which the through hole is formed in the magnet moving body 10 as the liquid passage. In addition, this construction provides waterproof of the outer circumference of the permanent magnet 27 with ease (i.e., the sleeve-like holder 28 can be fabricated with ease by deep drawing). Still further, the first and the second check valves 12, 25 are of such a simple design as to attract the magnetic valve bodies 15, 26 made of steel balls or the like with the permanent magnets, and this design also contributes to mechanical simplification.

Figure 12:
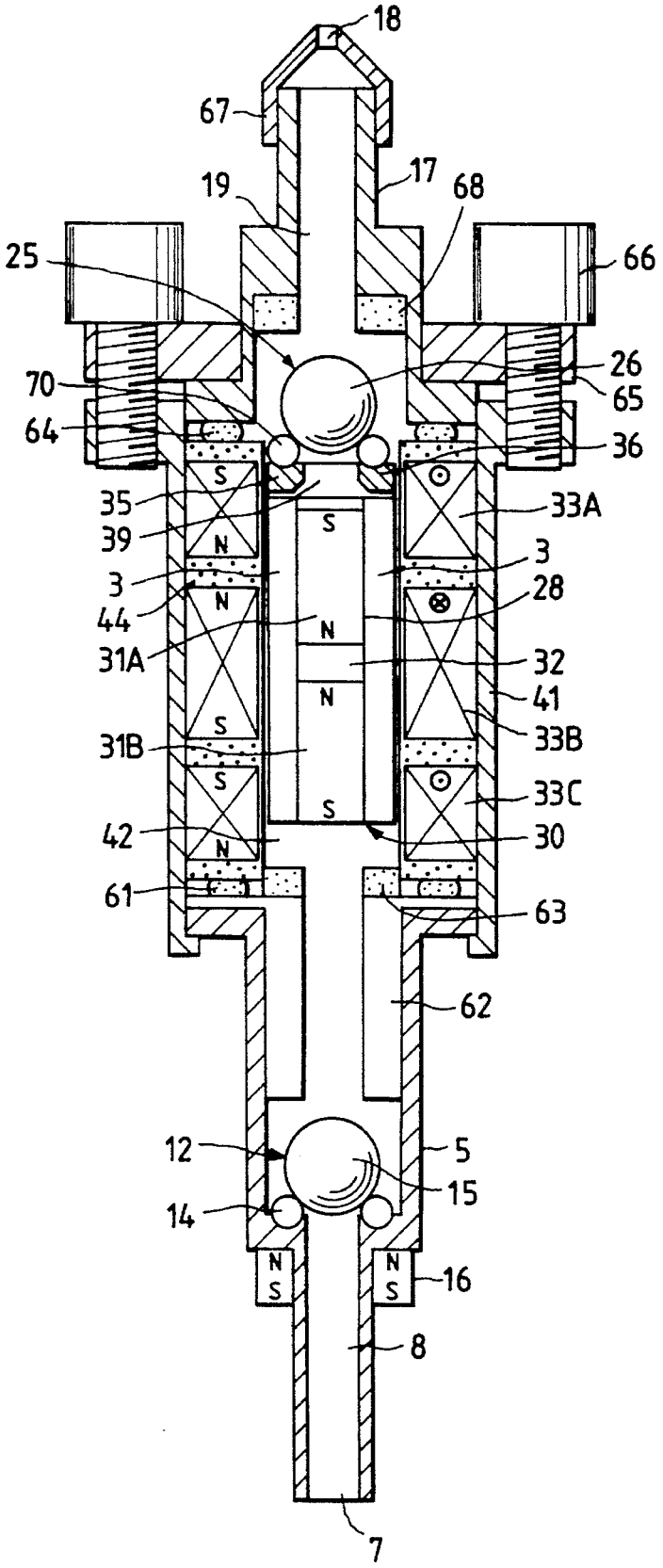
FIG. 12 is a front sectional view showing a movable magnet type pump, which is a fourth embodiment of the invention.

FIG. 12 shows a fourth embodiment of the invention. As shown in FIG. 12, a movable magnet type pump according to the fourth embodiment has a soft magnetic cylindrical yoke 41, three sets of coils 33A, 33B, 33C disposed inside the cylindrical yoke 41, and a magnet moving body 30. The three sets of coils 33A, 33B, 33C are fixed on the cylindrical yoke 41 by a guide sleeve 44. The inner circumference of the guide sleeve 44 forms a liquid introducing chamber 42 for slidably guiding the magnet moving body 10. The guide sleeve 44 is made of an insulating material (nonmagnetic material) such as an insulating resin or the like.

The magnet moving body 30 is formed by covering two substantially rod-like rare earth permanent magnets 31A, 31B and a substantially cylindrical intermediate soft magnetic body 32 interposed between these permanent magnets 31A, 31B with a nonmagnetic sleeve-like holder 28. At least one of grooves 3 serving as liquid passages is formed in the axial direction on the outer circumference of the magnet moving body 30. That is, the sleeve-like holder 28 has grooves 3 on the outer circumference thereof. The permanent magnets 31A, 31B and the substantially cylindrical intermediate soft magnetic body 32 are fixed inside the sleeve-like holder 28. It is preferable that the sleeve-like holder 28 cover not only the outer circumference of a body coupling the permanent magnets 31A, 31B to the substantially cylindrical intermediate soft magnetic body 32, but also both end surfaces thereof. Also, a valve seat part 35 is integrally secured to the liquid discharge side of the magnet moving body 30, and a seal member 70 is fixed on the valve seat part 35. How the valve seat part 35 is constructed and secured to the sleeve-like holder 28 is similar to that in the third embodiment.

The coils 33A, 33B, 33C are annularly wound, and are connected so that current flows in directions different from one another with a zone between the poles of the permanent magnets 31A, 31B as a boundary. That is, it is so designed that the coil 33B in the middle encloses the end parts including the intermediate soft magnetic body 32 and the N-poles of the permanent magnets 31A, 31B, and that the coils 33A, 33C on both ends enclose the end parts including the S-poles of the permanent magnets 31A, 31B. The direction of the current flowing through the coil 33B in the middle is opposite to that of the current flowing through the coils 33A, 33C on both ends (see N, S designed on the respective coils in FIG. 12).

A liquid introducing side member 5 is fixed on an end of the liquid introducing chamber 2 constituting guide sleeve 44 so as to be watertight through an O-ring 61 and a stopper plate 62. That the first check valve 12 is disposed on the liquid introducing side member 5 and other constructional aspects are similar to those in the third embodiment.

A liquid discharge side member 17 is fixed on the other end of the liquid introducing chamber 2 constituting guide sleeve 44 so as to be watertight through an O-ring 64. That the nozzle member 67 having a liquid discharge opening 18 communicating with the liquid discharge path 19 is secured to a distal end of the liquid discharge side member 17, and other constructional aspects are also similar to those in the third embodiment.

Further, a magnetic valve body 26 made of a steel ball or the like is disposed so that a second check valve 25 is formed together with the seal member 70 on the liquid discharge side of the valve seat part 35 integrally secured to the magnet moving body 30. The magnetic valve body 26 is attracted in such a direction as to close the inner circumferential hole 39 of the valve seat part 35 by the permanent magnet 31A inside the magnet moving body 30. A cushion member 68 for regulating the strokes of the valve body 26 and the magnet moving body 30 is fixed on a recess inside the liquid discharge side member 17.

The same or like parts and components as those of the third embodiment are designated by the same reference numerals, and the descriptions thereof are omitted.

In the construction of the fourth embodiment, the magnet moving body 30 can be caused to reciprocate inside the liquid introducing chamber 42 by applying alternating current to the three coils 33A, 33B, 33C in such a manner that each of the three coils 33A, 33B, 33C can generate a magnetic field of an opposite polarity alternately. As a result, in a stroke toward the liquid discharge side, the magnet moving body 30 moves with the magnetic valve body 26 of the second check valve 25 closing the inner circumferential hole 39 of the valve seat part 35 (i.e., with the magnetic valve body 26 closing the liquid passage), which thus allows liquid (e.g., liquid such as water or kerosene) to be introduced into the liquid introducing chamber 42 via the liquid introducing opening 7, the liquid introducing path 8, and the first check valve 12. In a stroke toward the liquid introducing side, the magnet moving body 30 moves with the magnetic valve body 15 of the first check valve 12 closing the liquid introducing path 8, which thus allows the liquid inside the liquid introducing chamber 42 to move toward the liquid discharge side of the magnet moving body 30 via the second check valve 25. As the magnet moving body 30 further moves toward the liquid discharge side, the liquid is discharged from the liquid discharge opening 18 via the liquid discharge path 19.

According to the fourth embodiment of the invention, the magnet moving body 30 can be caused to reciprocate efficiently by a force similar to a thrust based on the Fleming's left hand rule that acts on both the magnetic flux produced from the respective permanent magnets of the magnet moving body 30 and the current flowing through the three coils 33A, 33B, 33C that cut across the magnetic flux. Since the magnet moving body 30 is formed of a structure in which the soft magnetic body is interposed between the two permanent magnets with the same poles of the permanent magnets confronting each other, a magnetic flux density component perpendicular to the direction of magnetization (axial direction) of the respective permanent magnets can be increased sufficiently and the magnetic flux generated by all the poles of the permanent magnets can be utilized efficiently. Therefore, the thrust based on the Fleming's left hand rule that acts on the magnetic flux and the current flowing through the three coils 33A, 33B, 33C wound around the magnet moving body 30 can be increased sufficiently. Thus, even if the magnet moving body 30 is downsized, a drive force therefor can be increased significantly. Other effects and advantages are similar to those in the third embodiment.

Figure 13:
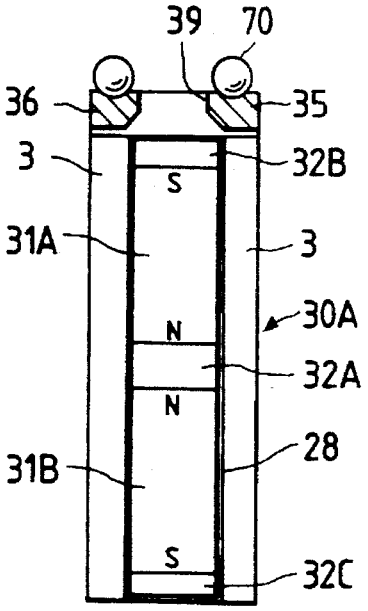
FIG. 13 is a front sectional view showing a modified example of the magnet moving body, which can be applied to the fourth embodiment.

FIG. 13 shows a modified example of the magnet moving body applicable to the fourth embodiment. In this case, a magnet moving body 30A is formed by covering two substantially rod-like rare earth permanent magnets 31A, 31B, a substantially cylindrical intermediate soft magnetic body 32A, and substantially cylindrical end soft magnet bodies 32B, 32C with a nonmagnetic sleeve-like holder 28. The permanent magnets 31A, 31B are arranged so that the same poles thereof confront each other. The substantially cylindrical intermediate soft magnetic body 32A is firmly fixed between these permanent magnets 31A, 31B. The substantially cylindrical end soft magnetic bodies 32B, 32C are secured to the outermost end surfaces of the permanent magnets 31A, 31B. Grooves 3 serving as liquid passages are formed in the axial direction on the outer circumference of the magnet moving body 30A. That is, the sleeve-like holder 28 has grooves 3 on the outer circumference thereof, and the permanent magnets 31A, 31B, the substantially cylindrical intermediate soft magnetic body 32A, and the end soft magnetic bodies 32B, 32C are fixed inside the sleeve-like holder 28. It is preferable that the sleeve-like holer 28 cover not only the outer circumference of a body coupling the substantially rod-like permanent magnets 31A, 31B to the substantially cylindrical soft magnetic bodies 32A, 32B, 32C, but also both end surfaces thereof. Further, a valve seat part 35 is integrally secured to the liquid discharge side of the magnet moving body 30A, and a seal member 70 is fixed on the valve seat part 35. How the valve seat part 35 is constructed and fixed on the sleeve-like holder 28 is similar to that in the third embodiment.

The magnet moving body 30A of FIG. 13 has the advantage that magnetic flux generated from the outer side end surfaces of the permanent magnets is easy to bend in the perpendicular direction (in the direction of the yoke) owing to the presence of the end surface soft magnetic bodies 32B, 32C. As a result, by combining the three coils 33A, 33B, 33C of the fourth embodiment, an improvement in thrust by about several to 10 percentage points can be achieved.

Figure 14:
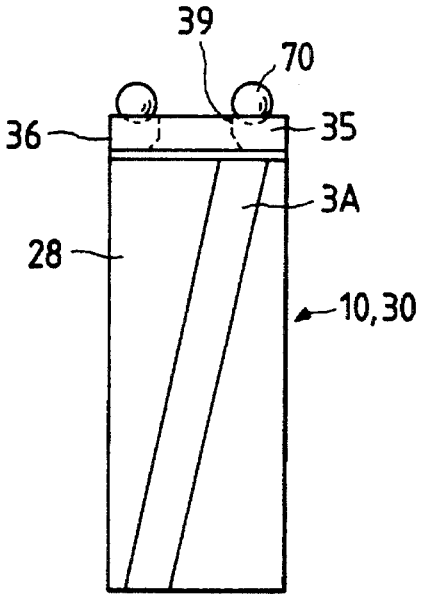
FIG. 14 is a front view showing a modified example of a groove structure of the magnet moving body, which can be applied to the third and the fourth embodiments.

FIG. 14 shows a modified example of the grooves of the magnet moving body applicable to the third or the fourth embodiment. In this case, grooves 3A of the magnet moving body 10, 30 are formed on the outer circumference of the sleeve-like holder 28 so as to be inclined with respect to the axial direction of the magnet moving body. As a result, the magnet moving body 10, 30 reciprocates with rotation, which prevents the nonmagnetic sleeve-like holder 28 constituting the outer circumferential part of the magnet moving body 10, 30 from being locally worn, thereby contributing to improving wear resistance of the sleeve-like holer 28. That the valve seat part 35 is integrally secured to the liquid discharge side of the magnet moving body 30A, that the seal member 70 is fixed on the valve seat part 35, and other constructional aspects are similar to those in the third embodiment.

Figure 15:
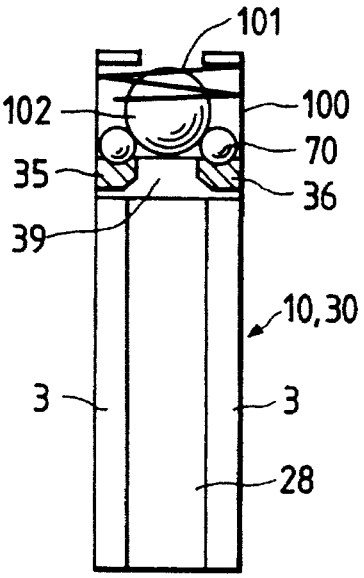
FIG. 15 is a front sectional view showing a modified example of the second check valve in the third or the fourth embodiment.

FIG. 15 shows a modified example of the second check valve in the third or the fourth embodiment. An extension 100 of the nonmagnetic sleeve-like holder 28 is disposed on the liquid discharge side of the magnet moving body 10, 30 so that the extension 100 can hold a spring 101 and a valve body 102 that is in spherical or like form. Therefore, the valve body 102 is biased by the spring 101 in such a direction as to come in pressure contact with the seal member 70 disposed on the end surface on the liquid discharge side of the magnet moving body 10, 30 to thereby close the inner circumferential hole 39 of the valve seat part 35. In the construction of FIG. 15, it is not necessary that the valve body 102 be magnetic. That the valve seat part 35 is integrally secured to the liquid discharge side of the magnetic moving body 10, 30, that the seal member 70 is fixed on the valve seat part 35, and other constructional aspects are similar to those in the third embodiment.

Figure 16:
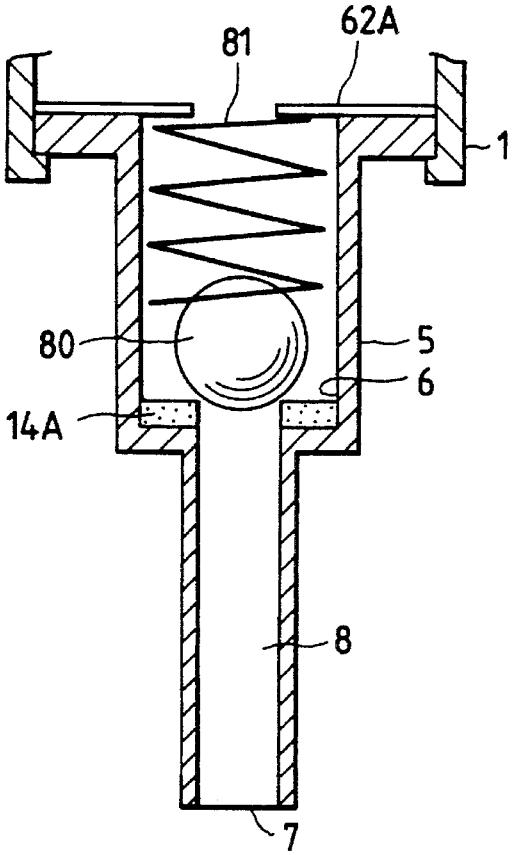
FIG. 16 is a partially sectional view showing a modified example of the first check valve in the third or the fourth embodiment.

FIG. 16 shows a modified example of the first check valve in the third or the fourth embodiment. A seal member 14A made from rubber or the like is fixed on a portion of the large-diameter part 6 of the liquid introducing member 5, the portion being supposed to become a valve seat, and a valve body 80 that is in spherical or like form is biased by a spring 81 so that the valve body 80 comes in pressure contact with the seal member 14A. The stopper plate 62 serves also as a spring retainer. Reference numeral 1 designates a yoke; and 8, a liquid introducing path. Like the other modified examples, it is not necessary that the valve body 80 be magnetic in the construction of FIG. 16.

Figure 17:
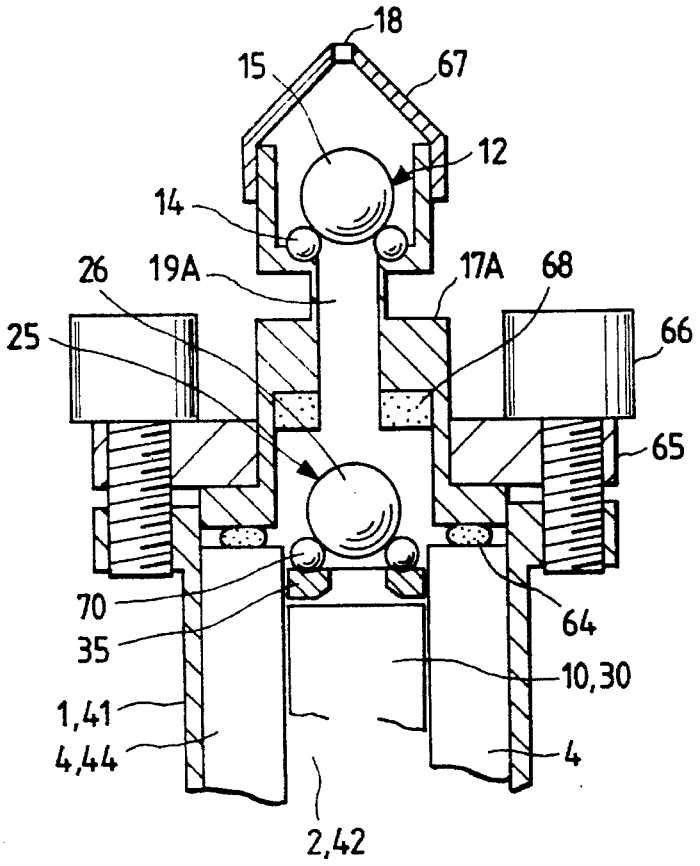
FIG. 17 is a partially sectional view showing a modified example in which the first check valve in the third or the fourth embodiment is moved to the liquid discharge side.
Figure 19:
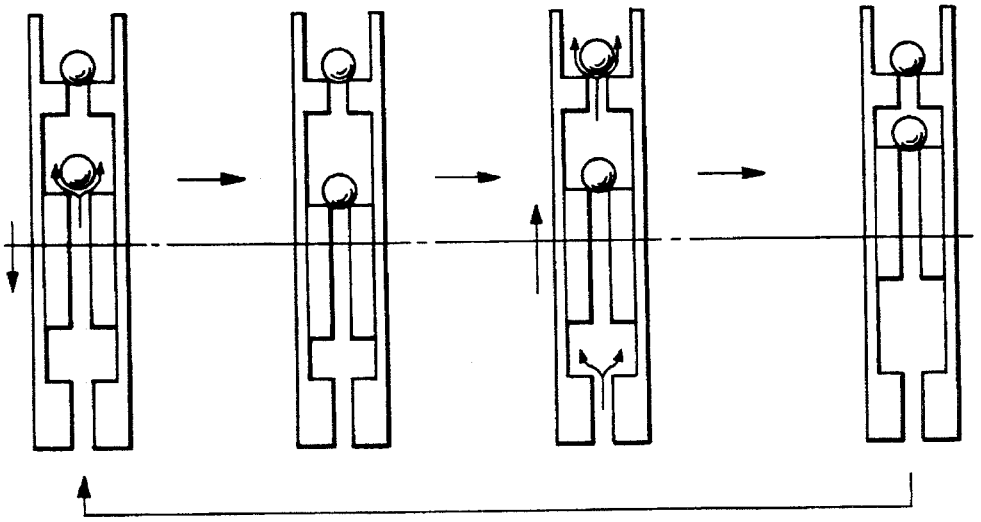
FIG. 19 is a diagram showing an operation when the first check valve is moved to the liquid discharge side.

FIG. 17 shows a modified example in which the first check valve in the third or the fourth embodiment is moved to the liquid discharge side. A liquid discharge side member 17A has therewithin a liquid discharge path 19A that communicates with the liquid introducing chamber 2, 42 in which the magnet moving body 10, 30 reciprocates, and the first check valve 12 is disposed at a position along the liquid discharge path 19A. That is, the liquid discharge path 19A is designed so as to be closed when the valve body 15 comes in pressure contact with the seal member 14 of the large-diameter part. While not shown in the drawing, the valve body 15 is biased by a spring or the like in such a direction as to come in pressure contact with the seal member 14. The same or like parts and components as those of the third or the fourth embodiment are designated by the same reference numerals. An operation is shown in FIG. 19.

Figure 18:
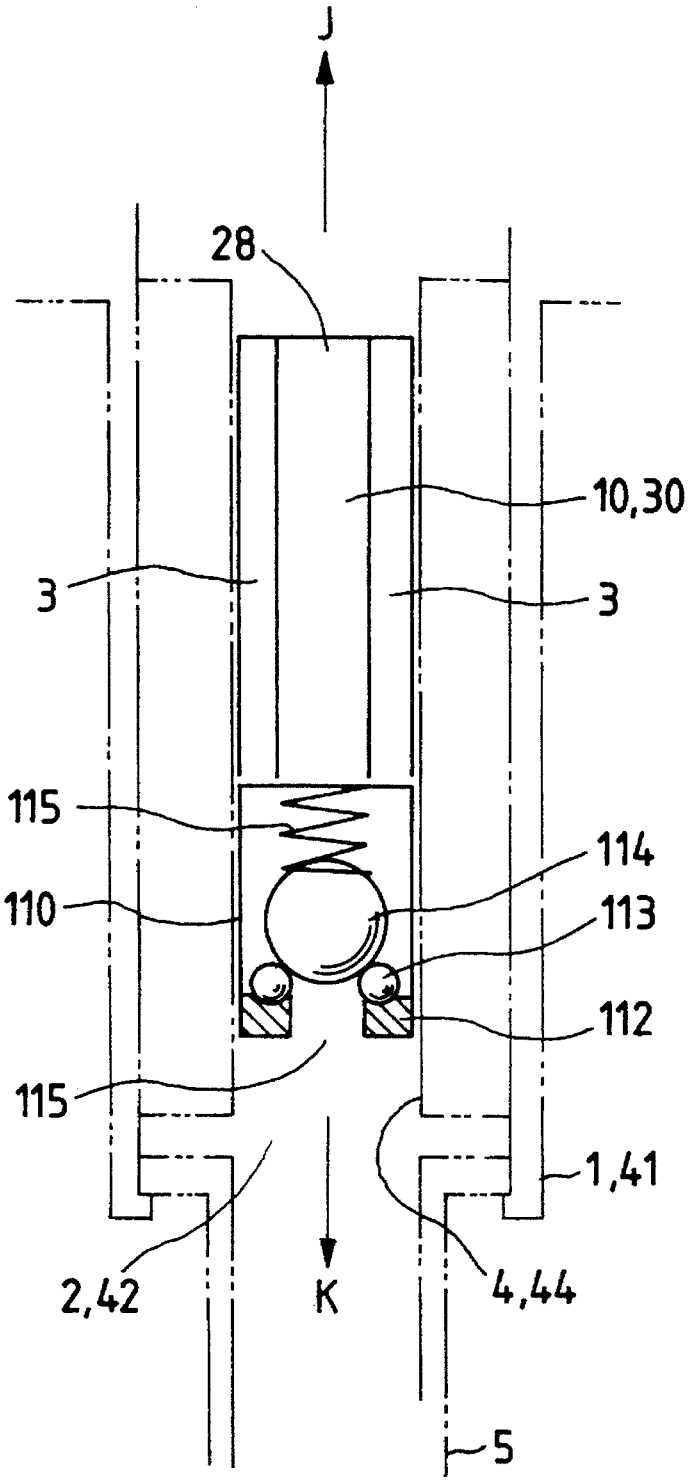
FIG. 18 is a partially sectional view showing a modified example in which the second check valve in the third or the fourth embodiment is moved to the liquid introducing side of the magnet moving body.

FIG. 18 shows a modified example in which the second check valve in the third or the fourth embodiment is moved to the liquid introducing side of the magnet moving body. In this case, a cylindrical extension member 110 is integrally coupled to the nonmagnetic sleeve-like holder 28 of the magnet moving body 10, 30. A valve seat 112 is fixed on the inner side of a folded part 111 of a distal end of the cylindrical extension member 110. A seal member (O-ring) 113 is secured to the valve seat 112. Inside the cylindrical extension member 110 is a spherical valve body 114 made of a nonmagnetic material such as a resin, which valve body 114 is biased by a compression spring 115 in such a direction as to come in pressure contact with the seal member 113. In FIG. 18, reference numerals 1, 41 designate a cylindrical yoke; and 4, 44, a guide sleeve.

In the construction of FIG. 18, in a stroke in which the magnet moving body 10, 30 moves toward the liquid discharge side as indicated by an arrow J, the valve body 114 of the second check valve closes an end opening 115 of the cylindrical extension member 110 with the valve body 114 coming in pressure contact with the seal member 113 on the valve seat 112 (i.e., with the valve body 114 closing the liquid passage); and in a stroke in which the magnet moving body 10, 30 moves toward the liquid introducing side as indicated by an arrow K, the first check valve closes the liquid introducing path. Therefore, the valve body 114 of the second check valve moves away from the seal member 113, allowing the liquid within the liquid introducing chamber 2, 42 to move in such a direction as to enter the grooves 3 of the magnet moving body 10, 30 (toward the liquid discharge side) through the second check valve.

Structures other than those exemplified in FIGS. 15 to 18 may also be applied to the first and the second check valves.

Having described the embodiments of the invention, it is not our intention that the invention be limited thereto. It is apparent to those skilled in the art that the invention may be modified in various forms within the spirit and scope as set out in the appended claims.

As described in the foregoing, the movable magnet type pumps of the invention are characterized as arranging the magnet moving body having the through liquid passage or the magnet moving body having the grooves serving as liquid passages, and causing such magnet moving body to reciprocate within the liquid introducing chamber by utilizing electromagnetic force generated between the magnet moving body and the current applied to the plurality of coils. Therefore, the pump is slimmed down mechanically by eliminating the need for a mechanical return mechanism, thus allowing large pumping performance to be implemented with a small structure. Further, the arrangement in which the magnet moving body has the grooves is more advantageous in downsizing the pump compared with the arrangement in which the magnet moving body has the through hole. In addition, the former arrangement is advantageous in providing good waterproof of the permanent magnet or magnets contained in the magnet moving body.

Figure 20:
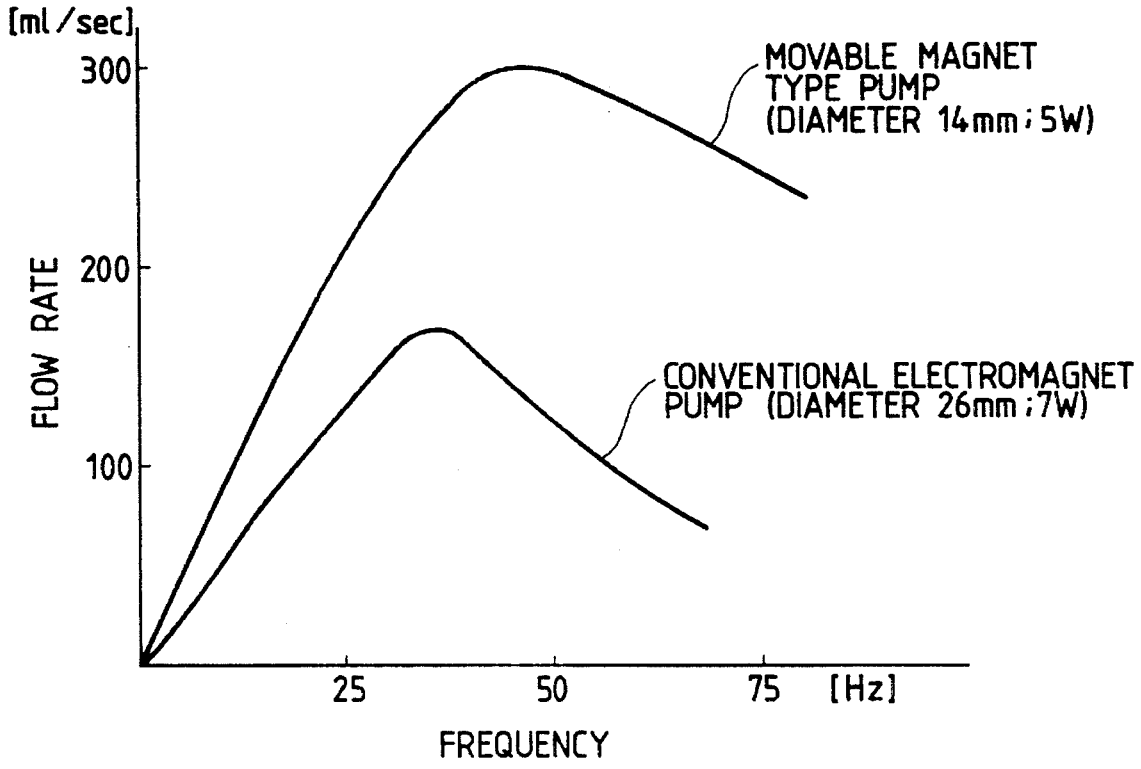
FIG. 20 is a diagram comparing the liquid raising performance of the movable magnet type pump of the invention with that of the conventional electromagnetic pump.

FIG. 20 shows a comparison of the pumping performance between the movable magnet type pump of the invention and the conventional electromagnetic pump. It is apparent from this drawing that the movable magnet type pump of the invention excels over the conventional example in both flow rate characteristics as well as in frequency characteristics.

What is claimed is:

1. A movable magnet type pump comprising:

a magnet moving body having at least one axially magnetized permanent magnet and an axially extending liquid passage extending from an upstream end of said magnet moving body to a downstream end of said magnet moving body, the magnet moving body being disposed within a liquid introducing chamber so as to be slidable therewithin;

a plurality of coils being fixed so as to enclose the liquid introducing chamber;

a first check valve being disposed on a liquid passage communicating with the liquid introducing chamber;

a second check valve being disposed on the axially extending liquid passage of the magnet moving body and including a valve seat at a downstreammost end surface of said magnet moving body at which said magnet moving body terminates, said valve seat including a downstreammost opening, and wherein said second check valve includes a valve body closure member which is larger than said downstreammost opening of said valve seat;

the movable magnet type pump further including a discharge member having a discharge path therein, and wherein said valve body closure member is disposed between said downstreammost opening of said valve seat and said discharge path of said discharge member, said discharge member located downstream of said magnet moving body, and wherein the valve body closure member is between the downstreammost end surface of the magnet moving body and the discharge path of the discharge member;

wherein the magnet moving body includes at least two permanent magnets having like poles which confront each other and wherein the magnet moving body is caused to reciprocate by interaction between current applied to each of the plurality of coils and magnetic flux from the magnet moving body cutting across each of the plurality of coils.

2. The movable magnet type pump of claim 1, further including a seal member disposed on said downstream end of said magnet moving body, and a cushion member located at an upstream side of said discharge path of said discharge member.

3. A movable magnet type pump comprising:

a magnet moving body having at least one axially magnetized permanent magnet and an axially extending liquid passage, the magnet moving body being disposed within a liquid introducing chamber so as to be slidable therewithin;

a plurality of coils being fixed so as to enclose the liquid introducing chamber, a first check valve being disposed on a liquid passage communicating with the liquid introducing chamber;

a check valve being disposed on the liquid passage of the magnet moving body;

wherein the magnet moving body includes at least two permanent magnets having like poles which confront each other and wherein the magnet moving body is caused to reciprocate by interaction between current applied to each of the plurality of coils and magnetic flux from the magnet moving body cutting across each of the plurality of coils;

wherein the plurality of coils include at least three coils; and the at least three coils are connected so that current flows in directions different from one another with a zone between the respective permanent magnets as a boundary.

4. A movable magnet type pump according to claim 3, wherein the magnet moving body includes a magnetic body interposed between the at least two permanent magnets.

5. A movable magnet type pump according to claim 3, wherein the magnet moving body includes an intermediate magnetic body interposed between the at least two permanent magnets so as to contact respective first ends of said at least two permanent magnets, and also includes two additional end magnetic bodies located on opposite ends of the magnet moving body in contact with respective second ends of the at least two permanent magnets.

6. A movable magnet type pump according to claim 1, wherein the first check valve comprises a first magnetic valve body and a valve body attracting permanent magnet for biasing the first magnetic valve body in such a direction as to close the liquid passage communicating with the liquid introducing chamber with the valve body attracting permanent magnet.

7. A movable magnet type pump according to claim 1, wherein the second check valve has a second magnetic valve body for biasing the second valve body in such a direction as to close the liquid passage with the permanent magnet or magnets of the magnet moving body.

8. A movable magnet type pump according to claim 1, wherein the liquid passage passes through the permanent magnet.

9. A movable magnet type pump comprising:

a magnet moving body having at least one axially magnetized permanent magnet and an axially extending liquid passage, the magnet moving body being disposed within a liquid introducing chamber so as to be slidable therewithin;

a plurality of coils being fixed so as to enclose the liquid introducing chamber;

a first check valve being disposed on a liquid passage communicating with the liquid introducing chamber;

a second check valve being disposed on the liquid passage of the magnet moving body;

wherein the magnet moving body includes at least two permanent magnets having like poles which confront each other and wherein the magnet moving body is caused to reciprocate by interaction between current applied to each of the plurality of coils and magnetic flux from the magnet moving body cutting across each of the plurality of coils;

the movable magnet type pump further comprising:

a magnetic yoke disposed on an outer circumferential side of the coils; and a magnetic circuit for increasing a magnetic flux component in a direction perpendicular to the axial direction of the magnet moving body.

10. A movable magnet type pump comprising:

a magnet moving body having at least one axially magnetized permanent magnet and an axially extending liquid passage, the magnet moving body being disposed within a liquid introducing chamber so as to be slidable therewithin;

a plurality of coils being fixed so as to enclose the liquid introducing chamber;

a first check valve being disposed on a liquid passage communicating with the liquid introducing chamber;

a second check valve being disposed on the liquid passage of the magnet moving body;

wherein the magnet moving body includes at least two permanent magnets having like poles which confront each other and wherein the magnet moving body is caused to reciprocate by interaction between current applied to each of the plurality of coils and magnetic flux from the magnet moving body cutting across each of the plurality of coils;

wherein the permanent magnet comprises at least one groove formed in an outer circumference thereof, and the liquid passage is constituted by a space formed between said groove and an inner wall of said liquid introducing chamber.

11. A movable magnet type pump according to claim 10, wherein the groove is formed on the outer circumference so as to be inclined with respect to the axial direction of the magnet moving body.

* * * * *